US012258888B2

(12) United States Patent
Alexandru et al.

(10) Patent No.: US 12,258,888 B2
(45) Date of Patent: Mar. 25, 2025

(54) VALVE ACTUATION SYSTEM COMPRISING HYDRAULIC LASH ADJUSTER OPERATING VIA A ONE-WAY COUPLING MECHANISM

(71) Applicant: Jacobs Vehicle Systems, Inc., Bloomfield, CT (US)

(72) Inventors: Matei Alexandru, Simsbury, CT (US); Gabriel S. Roberts, Wallingford, CT (US)

(73) Assignee: Jacobs Vehicle Systems, Inc., Bloomfield, CT (US)

( * ) Notice: Subject to any disclaimer, the term of this patent is extended or adjusted under 35 U.S.C. 154(b) by 0 days.

(21) Appl. No.: 18/654,952

(22) Filed: May 3, 2024

(65) Prior Publication Data

US 2024/0369001 A1 Nov. 7, 2024

Related U.S. Application Data

(60) Provisional application No. 63/499,745, filed on May 3, 2023.

(51) Int. Cl.
*F01L 1/46* (2006.01)
*F01L 1/18* (2006.01)
(Continued)

(52) U.S. Cl.
CPC ..... *F01L 1/46* (2013.01); *F01L 1/181* (2013.01); *F01L 1/2416* (2013.01); *F01L 1/26* (2013.01);
(Continued)

(58) Field of Classification Search
CPC . F01L 1/2416; F01L 1/181; F01L 1/26; F01L 1/46; F01L 2001/467; F01L 1/18; F01L 1/24
See application file for complete search history.

(56) References Cited

U.S. PATENT DOCUMENTS

2005/0188930 A1* 9/2005 Best ..... F01L 13/0005 123/90.2
2007/0193543 A1* 8/2007 Best ..... F01L 13/0005 123/90.39
(Continued)

FOREIGN PATENT DOCUMENTS

WO 2012162616 A1 11/2012
WO WO-2017197044 A1 * 11/2017 ..... F01L 1/18
WO WO-2023072432 A1 * 5/2023 ..... F01L 1/181

OTHER PUBLICATIONS

International Search Report for International application No. PCT/IB2024/054334; mailed on Jul. 30, 2024; 3 pages.
(Continued)

*Primary Examiner* — Wesley G Harris
(74) *Attorney, Agent, or Firm* — Jordan IP Law, LLC

(57) ABSTRACT

A valve actuation system comprises a first rocker assembly operatively connected to a first valve actuation motion source and to a first engine valve, with a first lost motion component arranged in series between a first input rocker and a first output rocker. A second rocker assembly is operatively connected to a second valve actuation motion source and to a second engine valve, with a second lost motion component arranged in series between a second input rocker and a second output rocker. A one-way coupling mechanism is disposed such that the second valve actuation motions are transferred to the first output rocker, but the first valve actuation motions are not transferred to the second output rocker. Furthermore, a primary hydraulic lash adjuster is configured in the second rocker assembly such that the primary hydraulic lash adjuster operates upon the first output rocker via the one-way coupling mechanism.

15 Claims, 10 Drawing Sheets

(51) Int. Cl.
*F01L 1/24* (2006.01)
*F01L 1/26* (2006.01)

(52) U.S. Cl.
CPC ..... *F01L 1/267* (2013.01); *F01L 2001/467* (2013.01); *F01L 2305/00* (2020.05)

(56) References Cited

U.S. PATENT DOCUMENTS

| | | | | |
|---|---|---|---|---|
| 2010/0242878 | A1* | 9/2010 | Maekawa | F01L 13/065 123/90.16 |
| 2014/0326212 | A1 | 11/2014 | Baltrucki et al. | |
| 2019/0264584 | A1* | 8/2019 | Baltrucki | F01L 1/2416 |
| 2019/0293001 | A1* | 9/2019 | Baltrucki | F01L 13/065 |
| 2020/0182097 | A1* | 6/2020 | Alexandru | F01L 1/181 |
| 2021/0262366 | A1* | 8/2021 | Van Wingerden | F01L 1/2416 |

OTHER PUBLICATIONS

Written Opinion of the International Searching Authority for International application No. PCT/IB2024/054334; mailed on Jul. 30, 2024; 4 pages.

* cited by examiner

VALVE ACTUATION SYSTEM COMPRISING HYDRAULIC LASH ADJUSTER OPERATING VIA A ONE-WAY COUPLING MECHANISM

FIELD

The present disclosure is generally directed to a system for actuating engine valves in an internal combustion engine and, in particular, to a valve actuation system comprising a hydraulic lash adjuster operating via a one-way coupling mechanism.

BACKGROUND

Co-pending U.S. patent application Ser. No. 18/540,611, filed Dec. 14, 2023 ("the '611 application"), the teachings of which are incorporated herein by this reference, discloses an embodiment of a valve actuation system as schematically depicted in FIG. 1. In particular, the valve actuation system 100 comprises a first rocker assembly 110 and a second rocker assembly 140. As shown, the first rocker assembly 110 is operatively connected to a first valve actuation motion source 120 and the second rocker assembly 140 is operatively connected to a second valve actuation motion source 150. First and second engine valves 162, 164 (both of which may be, for example, intake valves or exhaust valves) are associated with a cylinder 160 of an internal combustion engine, which valves 162, 164 are operatively connected to respective ones of the first rocker assembly 110 and the second rocker assembly 140. In this manner, the first and second rocker assemblies 110, 140 operate to actuate (i.e., open and close) the engine valves 162, 164 as commanded by the first and second valve actuation motion sources 120, 150 (and subject to operation of any incorporated lost motion components) as described in further detail below. Although only a single cylinder 160 is illustrated in FIG. 1, it is appreciated that an internal combustion engine may comprise more than one cylinder and the valve actuation systems described herein may be applied to any number of cylinders for a given internal combustion engine.

The valve actuation motion sources 120, 150 may comprise any combination of elements capable of providing valve actuation motions, such as a cam. Each of the valve actuation motion sources 120, 150 may be dedicated to providing main exhaust motions, main intake motions, auxiliary motions or a combination of main exhaust or main intake motions together with auxiliary motions. For example, in one embodiment, the first motion source 120 is configured to provide auxiliary valve actuation motions and the second motion source 150 is configured to provide main valve actuation motions (either exhaust or intake).

In this embodiment, the first rocker assembly 110 comprises a first input rocker 112, a first lost motion component 114 and a first output rocker 116 arranged in series. In particular, the first input rocker 112 is operatively connected to the first valve actuation motion source 120 and the first output rocker 116 is operatively connected to the first engine valve 162, with the first lost motion component 114 operatively connected to and deployed between the first input and output rockers 112, 116. The first input and output rockers 112, 116 may comprise center pivoting (possibly shaft mounted) rocker arms, though it is appreciated that the teachings of the instant disclosure may be equally applied to end pivoting rocker arms as well. Optionally, the '611 application discloses that a first hydraulic lash adjuster (HLA) 118 may be included in the first rocker assembly 110. In the illustrated example, the first HLA 118 as taught by the '611 application is deployed in the first output rocker 116, which may include hydraulic passages (not shown) suitable for providing hydraulic fluid to the first HLA 118. The '611 application further teaches that the first HLA 118 may instead be deployed as part of the other components 112, 114 constituting the first rocker assembly 110. Additionally, the '611 application teaches that when the first HLA 118 is provided, it may be desirable to control its operation, e.g., make it stroke limited, to ensure that placement of the first lost motion component 114 in its unlocked/motion absorbing state does not permit the HLA 118 to take up all lash in the first rocker assembly 110, which could lead to overextension of first engine valve 162 when the first lost motion component 114 is once again operated in its locked/motion conveying state. Alternatively, the '944 application teaches that prevention of engine valve overextension through operation of the HLA 118 may instead be provided, in this case, by stroke limiting incorporated into the first lost motion component 114 as well as a bias force supplied by the first lost motion component 114 sufficient to prevent overexpansion of the HLA 118.

As further depicted in FIG. 1, an engine controller 180 may be provided and operatively connected to the first lost motion component 114. The engine controller 180 may comprise any electronic, mechanical, hydraulic, electrohydraulic, or other type of control device for controlling operation of the lost motion mechanism 114, i.e., switching between its respective locked and unlocked states as described above. For example, the engine controller 180 may be implemented by a microprocessor and corresponding memory storing executable instructions used to implement the required control functions, including those described below, as known in the art. It is appreciated that other functionally equivalent implementations of the engine controller 180, e.g., a suitably programmed application specific integrated circuit (ASIC) or the like, may be equally employed. Further, the engine controller 180 may include peripheral devices, intermediate to engine controller 180 and the first lost motion component 114, that allow the engine controller 180 to effectuate control over the operating state of the lost motion device 114. For example, where the lost motion device 114 is a hydraulically controlled mechanism (i.e., responsive to the absence or application of hydraulic fluid to an input), such peripheral devices may include suitable solenoids.

As shown in FIG. 1, control of the first lost motion component 114 by the engine controller 180 is provided directly to the first lost motion component 114. In practice, however, such control may be provided via a path through at least one of the adjoining input or output rockers 112, 116. For example, in the various embodiments described herein, such control is provided through the use of hydraulic fluid supplied via one or more fluid passages formed in the first input or output rocker 112, 116 under the control of the engine controller 180. However, as will be appreciated by those having skill in the art, other types of control schemes may be equally employed for this purpose.

As further shown in FIG. 1, the second rocker assembly 140 comprises a second input rocker 142, a second lost motion component 144 and a second output rocker 146 arranged in series. In particular, the second input rocker 142 is operatively connected to the second valve actuation motion source 150 and the second output rocker 146 is operatively connected to the second engine valve 162, with the lost motion component 144 operatively connected to and deployed between the second input and output rockers 142, 146. The second input and output rockers 142, 146 may once again comprise center pivoting (possibly shaft mounted) rocker arms, though it is again appreciated that the teachings of the instant disclosure may be equally applied to the end pivoting rocker arms. Optionally, the '611 application discloses that a second hydraulic lash adjuster (HLA) 148 may be included in the second rocker assembly 140. In the illustrated example, the second HLA 148 as taught by the '611 application is deployed in the second output rocker 146, which may include hydraulic passages (not shown) suitable for providing hydraulic fluid to the second HLA 148. The '611 application further teaches that that the second HLA 148 may instead be deployed as part of the other components 142, 144 constituting the second rocker assembly 110. Additionally, the '611 application teaches that, as with the first HLA 118, it may be desirable to control operation of the second HLA 148 to prevent overextension of second engine valve 164 given the presence of the second lost motion component 144 in the second rocker assembly 140. Alternatively, the '611 application teaches, once again, that prevention of engine valve overextension through operation of the HLA 148 may instead be provided, in this case, by stroke limiting incorporated into the second lost motion component 144 as well as a bias force supplied by the first lost motion component 114 sufficient to prevent overexpansion of the HLA 148.

The controller 180 is configured to be operatively coupled to the second lost motion component 144, thereby controlling operation of the second lost motion component 144. Once again, though the controller 180 is illustrated as directly controlling the second lost motion component 144, it will be appreciated that such control may be mediated through paths provided in adjacent components, e.g., the second input rocker 142 and/or the second output rocker 146.

A feature of the illustrated embodiment is the provision of a one-way coupling (OWC) 170 between the second output rocker 146 of the second rocker assembly 140 and the first output rocker 116 of the first rocker assembly 110. The second output rocker 146 is capable of driving the first output rocker 116, but not vice versa, as indicated by the unidirectional arrows shown in FIG. 1 between the second rocker 146, the one-way coupling 170 and the first output rocker 116. That is, the presence of the one-way coupling 170 permits valve actuations provided by the second valve actuation motion source 150 to be applied to the first output rocker 116, whereas valve actuations provided by the first valve actuation motion source 120 cannot be applied to the second output rocker 146. In an embodiment, the one-way coupling 170 is implemented using fixed elements such that the one-way coupling 170 is "always there," i.e., the one-way coupling 170 is not selectable.

In an alternative embodiment taught in FIG. 1 of the '611 application but not illustrated here, the first rocker assembly 110 is as described above, but the second rocker assembly 140 may comprise on a single second rocker configured to directly receive valve actuation motions from the second motion source 150. That is, in this embodiment, the second rocker assembly 140 only includes the second output rocker 146 but not the second input rocker 142 or the second lost motion component 144.

Regardless, configured as shown in FIG. 1, the valve actuation system 100 provides various options for actuating the engine valves 162, 164. For example, where the second valve actuation motion source 150 provides main valve actuation motions and the first valve actuation motion source 120 provides auxiliary valve actuation motions, the first lost motion component 114 can be controlled to be in its unlocked or motion absorbing state such that auxiliary valve actuation motions applied to the first input rocker 112 are not conveyed by the first lost motion component 114 to the first output rocker 116 or, consequently, the first engine valve 162. Additionally, the second lost motion component 144 can also be controlled to be in its unlocked or motion absorbing state such that main valve actuation motions applied to the second input rocker 142 are not conveyed by the second lost motion component 144 to the second output rocker 146 or, consequently, the second engine valve 164 (or first engine valve by virtue of the one-way coupling 170). Such control of the engine valves 162, 164 can be used, for example, to implement cylinder deactivation (CDA) operation of the cylinder 160 or the engine.

Alternatively, based on this same example, where the first lost motion component 114 is once again operated in its unlocked/motion absorbing state and the second lost motion component 144 is operated in its locked/motion conveying state, the auxiliary valve actuation motions will not be conveyed to the first engine valve 162 whereas the main valve actuation motions will be conveyed to both the first and second valves 162, 164. Such control of the engine valves 162, 164 can be used, for example, to implement positive power generation operation of the engine.

In another alternative, based on this same example, where the first lost motion component 114 is operated in its locked/motion conveying state and the second lost motion component 144 is operated in its locked/motion conveying state, the auxiliary valve actuation motions will be conveyed to the first engine valve 162 and the main valve actuation motions will be conveyed to both the first and second valves 162, 164. Such control of the engine valves 162, 164 can be used to implement, for example, conventional 4-stroke, compression-release engine braking operation of the engine, or to provide other, additive auxiliary valve actuation motions (e.g., internal exhaust gas recirculation (IEGR), variable valve actuations (VVA), early exhaust valve opening (EEVO), late intake valve closing (LIVC), swirl control, etc.).

In yet another alternative, based on this same example, where the first lost motion component 114 is operated in its locked/motion conveying state and the second lost motion component 144 is operated in its unlocked/motion absorbing state, the auxiliary valve actuation motions will be conveyed to the first engine valve 162 whereas the main valve actuation motions will not be conveyed to either the first or second valves 162, 164. Such control of the engine valves 162, 164 can be used to implement operating modes in which auxiliary valve actuations, but not main valve actuations are desired. For example, such operating modes may include so-called 2-stroke or 1.5-stroke, compression-release engine braking operation of the engine.

The '611 application additionally teaches specific implementations of the first and second lost motion components 114, 144. FIG. 2 illustrates an example of such an implementation of a lost motion component 200 taught in the '611 application. The lost motion component 200 is depicted in cross section, thereby better illustrating a hydraulically controlled locking mechanism 210, constituting a subassembly of the lost motion component 200 and deployed between a housing 220 and a plunger 222. Although the housing 220 may be formed as a unitary element, in the example illustrated in FIG. 2, a closed end of the housing 220 is provided by an end cap 221 attached to the housing 220. A plunger spring 224 is deployed outside of the housing 220 and plunger 222. In the illustrated embodiment, the plunger spring 224 is deployed between a flange 226 formed on or attached to an outer surface of the plunger 222 and a shoulder 228 formed in the housing 220. In this manner, the plunger spring 224 biases the housing 220 and plunger 222 away from each other. It is appreciated that the plunger spring 224 could be deployed elsewhere between the housing 220 and plunger 222, for example, within the housing 220.

As shown in FIG. 2, the locking mechanism 210 includes the plunger 222 slidably disposed within a housing bore 230 formed in and extending along, and preferably concentric with, a longitudinal axis of the lost motion component 200 from a first end of the housing 220. An inner plunger 232 is slidably disposed in a longitudinal bore 234 formed in the plunger 222. An inner plunger spring 242 is provided between the inner plunger 242 and a plunger cap 245, thereby tending to bias the inner plunger out of the bore 234. Locking elements in the form of wedges 236 are provided, which wedges are configured to engage with an annular outer recess 238 formed in a surface defining the housing bore 230.

The illustrated embodiment is of a normally un-locked locking mechanism 210, i.e., in the absence of hydraulic control applied to the inner plunger 232 via, in this case, a lost motion hydraulic passage 240, the inner plunger spring 242 biases the inner plunger 232 into position such that the wedges 236 radially retract through openings formed in the plunger 220. As a result, the wedges 236 disengage from the outer recess 238 thereby effectively unlocking the plunger 222 relative to the housing 220, i.e., such that the plunger 222 is free to slide within the housing 220 subject, in this case, to the bias provided by the plunger spring 224. In this unlocked state, any valve actuation motions applied to the lost motion component 200 will cause the plunger 222 to reciprocate in its bore 230. In this manner, and presuming travel of the plunger 222 within its bore 230 is greater than the maximum extent of any applied valve actuation motions (i.e., that the plunger 222 is unable to bottom out in its bore 230), such valve actuation motions are not conveyed by the lost motion component 200 and are effectively lost. Alternatively, travel of the plunger 222 within its bore 230 could be configured such that the plunger 222 "bottoms out," i.e., makes contact with the closed end of the bore 230, so as to always provide a "failsafe" valve lift in the event of a failure of the locking mechanism 210.

On the other hand, provision of hydraulic fluid, via the lost motion hydraulic passage 240, to the input-receiving end (bottommost surface as shown in FIG. 3A) of the inner plunger 232 sufficiently pressurized to overcome the bias of the inner piston spring 242, causes the inner plunger 232 to translate upward (as depicted) within the bore 234 such that the wedges 236 are forced to radially extend through the openings formed in the plunger 222 and engage with the outer recess 238, thereby effectively locking the plunger 222 relative to the housing 220. In this locked state, valve actuation motions (whether main or auxiliary motions) applied to the lost motion component 200 will cause the plunger 222 to engage the housing 220 thereby transmitting such valve actuation motions.

It is noted that, when the locking mechanism 210 is in the locked state, a longitudinal extent of the outer recess 238 is greater than a thickness of the wedges 236 such that a small amount of movement is nevertheless permitted between the plunger 222 and housing 220. Such additional space provided by the outer recess 238 facilitates locking/unlocking of the locking mechanism 210 when the lost motion component 200 is unloaded.

The bias applied by the plunger spring 224 can be selected to additionally ensure that the adjacent valve train components 252, 254 (e.g., rocker arms as described below or such additional up- or downstream valve train components in the system, not shown) are biased into continuous contact with respective endpoints of the valve train, i.e., valve actuation motions sources and engine valves.

Although FIG. 2 illustrates a particular embodiment and configuration of a lost motion component 200, it is understood that other configurations may be equally employed and the instant disclosure is not limited in this regard. For example, as noted previously, the illustrated lost motion component 200 is a normally unlocked lost motion component. However, as will be appreciated by those skilled in the art, normally locked types of lost motion components may be equally employed.

Referring once again to FIG. 1, if the first lost motion component 114, such as the lost motion component 200 illustrated in FIG. 2, is in the unlocked state while valve actuation motions from the second valve actuation motion source 150 (e.g., main valve events) are conveyed by the one-way coupling 170 to the first output rocker 116, operation of the plunger spring 224 will cause the housing 220 and the plunger 222 to slide away from each other. That is, the plunger spring 224 will cause the plunger 222 and the first input rocker 112 to be biased toward the first motion source 120 and the housing 220 to be biased toward the first output rocker 116 when the first output rocker 116 is urged toward the first engine valve 162 as commanded by the one-way coupling mechanism 170. With reference to FIG. 2, separation of the housing 220 and plunger 222 would result in an increase in the so-called "ball to ball" distance, D (referring to the hemispherical ball joints 244, 243 used to maintain the lost motion component 200 in position between the adjacent valve train components 252, 254 while still permitting rotational movement of the lost motion component 200 relative to the adjacent valve train components 252, 254). However, if the ball to ball distance, D, is not restrained below a maximum value, the possibility exists of the wedges 238 extending out beyond the bore 230 of the housing 220 and thereby coming dislodged, or even the plunger 222 coming dislodged from the housing 220.

To prevent such an occurrence, it has been proposed (for example, in U.S. patent application Ser. No. 18/484,053, filed Oct. 10, 2023) to implement a "carry along" feature between the first output rocker 116 and the first input rocker 112, schematically illustrated by reference numeral 190 in FIG. 1. The carry along feature 190 is designed such that rotation of the first output rocker 116 caused by the one-way coupling mechanism 170 will cause the carry along feature 190 to engage the first input rocker 112 and induce the input rocker 112 to also rotate as commanded by first output rocker 116 (which, once again, is being commanded by the one-way coupling mechanism 170). The carry along feature 190 (such as respective contact surfaces on the first input and output rockers 112, 116 aligned with each other) is also designed such that rotation of the input rocker 112 will be induced before the ball to ball distance, D, of the lost motion component 114, 200 exceeds a maximum value, thereby preventing the above-noted problems.

While the carry along feature 190 can successfully ensure that the ball to ball distance, D, of the first lost motion component 114, 200 does not exceed a desired maximum value, it can give rise to other difficulties under certain conditions. For example, the valve actuation system of FIG. 1 could be used to actuate exhaust valves during so-called high power density (HPD), compression-release engine braking. Specifically, and as shown in FIG. 3, the first valve actuation motion source 120 could provide auxiliary exhaust valve actuation motions 302 (illustrated with light lines) used to effectuate 1.5 stroke or 2.0 stroke HPD engine braking (including a first compression-release event 306, a first brake gas recirculation (BGR) event 308, a second compression-release vent 310 and a second BGR event 312) whereas the second valve actuation motion source 150 could provide an exhaust main event 304. As known in the art, during 1.5 stroke HPD engine braking, an intake main event 305 is provided while the exhaust main event 304 is simultaneously lost and replaced by the auxiliary exhaust valve actuation motions 302, whereas during 2.0 stroke HPD engine braking, both the exhaust and intake main events 304, 305 are lost and respectively replaced by the auxiliary exhaust valve actuation motions 302 and auxiliary intake valve actuation motions (not shown in FIG. 3).

In this configuration, and assuming implementation of the carry along feature 190, when the first lost motion component 114 is in its unlocked condition but the second lost motion component 144 is in its locked condition, rotation of the first output rocker 116 by the one-way coupling mechanism 170 will likewise cause the carry along feature 190 to rotate the first input rocker 112 according to the main exhaust event 304 provided by the second motion source 150. As a result, the first input rocker 112 will lose contact with the first motion source 120 approximately at a point 314 where the lift provided by the main exhaust event 304 to the first output rocker 116 exceeds the lift provided by the first BGR event 308 provided to the first input rocker 112, i.e., at approximately 180° crank angle as shown in FIG. 3. However, during the closing of the main exhaust event 304, during a period, T, in which the main exhaust event 304 and the second compression-release event 310 overlap, the first input rocker 112 will be moving at relatively high velocity toward the first motion source 120 (i.e., cam) whereas a cam lobe providing the second compression-release event 310 will be moving toward the first input rocker 112. As a result, the first input rocker 112 (more specifically, a cam follower deployed thereon) will experience a significant impact with the first motion source 120 approximately at a point 316 where the lift provided by the first BGR event 308 to the first input rocker 112 exceeds the lift provided by the main exhaust event 304 to the first output rocker 116, i.e., at approximately 350° crank angle as shown in FIG. 3. Such high velocity impacts can lead to valve train damage.

Valve actuation systems comprising lost motions components that overcome the above-described limitations while still providing varied valve actuation functionality and flexibility, particularly HPD engine braking operation, would represent a welcome advancement of the art.

SUMMARY

The instant disclosure describes various embodiments of a valve actuation system for actuating at least two engine valves in an internal combustion engine. In an embodiment, such a system comprises a first rocker assembly operatively connected to a first valve actuation motion source and to a first engine valve of the at least two engine valves. The first rocker assembly comprises a first lost motion component arranged in series with a first input rocker and a first output rocker, the first input rocker configured to receive first valve actuation motions from the first valve actuation motion source and the first output rocker configured to impart the first valve actuation motions to the first engine valve. The first lost motion component is operable, in a motion absorbing state, to prevent conveyance of the first valve actuation motions from the first input rocker to the first output rocker and, in a motion conveying state, to convey the first valve actuation motions from the first input rocker to the first output rocker. A second rocker assembly is operatively connected to a second valve actuation motion source and to a second engine valve of the at least two engine valves. The second rocker assembly comprises a second lost motion component arranged in series with a second input rocker and a second output rocker, the second input rocker configured to receive second valve actuation motions from the second valve actuation motion source and the second output rocker configured to impart the second valve actuation motions to the second engine valve. The second lost motion component is operable, in a motion absorbing state, to prevent conveyance of the second valve actuation motions from the second input rocker to the second output rocker and, in a motion conveying state, to convey the second valve actuation motions from the second input rocker to the second output rocker. A one-way coupling mechanism is disposed between the first output rocker and the at least one second rocker such that the second valve actuation motions are transferred from the at least one second rocker to the first output rocker, and the first valve actuation motions are not transferred from the first output rocker to the at least one second rocker. Furthermore, a primary hydraulic lash adjuster is configured in the second rocker assembly such that the primary hydraulic lash adjuster operates upon the first output rocker via the one-way coupling mechanism. In an embodiment, the primary hydraulic lash adjuster may be disposed in the second output rocker.

In another embodiment, each of the first input rocker, the first output rocker, the second input rocker and the second output rocker comprises a shaft-mounted half rocker.

In another embodiment, the one-way coupling mechanism comprises a second extension forming a part of the at least one second output rocker and a first extension forming a part of the first output rocker, and wherein the first and second extensions are configured to contact each other.

In another embodiment, the first lost motion component comprises a hydraulically controlled locking mechanism. Furthermore, the first lost motion component may comprise a first spring that biases the first input rocker toward the first valve actuation motion source and biases the first output rocker toward the first engine valve. Further still, the first lost motion component may have a longitudinal extent sufficient to accommodate motions applied to the first output rocker via the one-way coupling mechanism. The first lost motion component may also be configured to be stroke-limited.

In another embodiment, the system may comprise a secondary hydraulic lash adjuster disposed between the second output rocker and the second engine valve. In this case, a secondary lash prevention force provided by the secondary hydraulic lash adjuster is preferably less than a primary lash prevention force provided by the primary hydraulic lash adjuster.

In an embodiment, the second lost motion component comprises a hydraulically controlled locking mechanism. Furthermore, the second lost motion component may comprise a second spring that biases the first input rocker toward the second valve actuation motion source and biases the second output rocker toward the second engine valve. Further still, the second lost motion component may be configured to be stroke-limited.

In yet another embodiment, a system includes a first rocker assembly operatively connected to a first valve actuation motion source and to a first engine valve of the at least two engine valves. The first rocker assembly comprises a first lost motion component arranged in series with a first input rocker and a first output rocker, the first input rocker configured to receive first valve actuation motions from the first valve actuation motion source and the first output rocker configured to impart the first valve actuation motions to the first engine valve. The first lost motion component is operable, in a motion absorbing state, to prevent conveyance of the first valve actuation motions from the first input rocker to the first output rocker and, in a motion conveying state, to convey the first valve actuation motions from the first input rocker to the first output rocker. A second rocker assembly is operatively connected to a second valve actuation motion source and to a second engine valve of the at least two engine valves. The second rocker assembly comprise at least one second rocker configured to receive second valve actuation motions from the second valve actuation motion source and to impart the second valve actuation motions to the second engine valve. A one-way coupling mechanism is disposed between the first output rocker and the at least one second rocker such that the second valve actuation motions are transferred from the at least one second rocker to the first output rocker, and the first valve actuation motions are not transferred from the first output rocker to the at least one second rocker. In this embodiment, the first rocker assembly comprises a hydraulic lash adjuster, and the first valve actuation motion source includes a refill period comprising a sub-base circle lift configured to eliminate load placed upon the hydraulic lash adjuster by expansion of the first lost motion component.

BRIEF DESCRIPTION OF THE DRAWINGS

The foregoing and other features and advantages will be discussed in detail in the following non-limiting description of specific embodiments in connection with the accompanying drawings, in which.

DETAILED DESCRIPTION OF THE PRESENT EMBODIMENTS

As used herein, the term "operatively connected" is understood to refer to at least a functional relationship between two components, i.e., that the claimed components must be connected (potentially including the presence of intervening elements or components) in a way to perform an indicated function.

Figure 2:
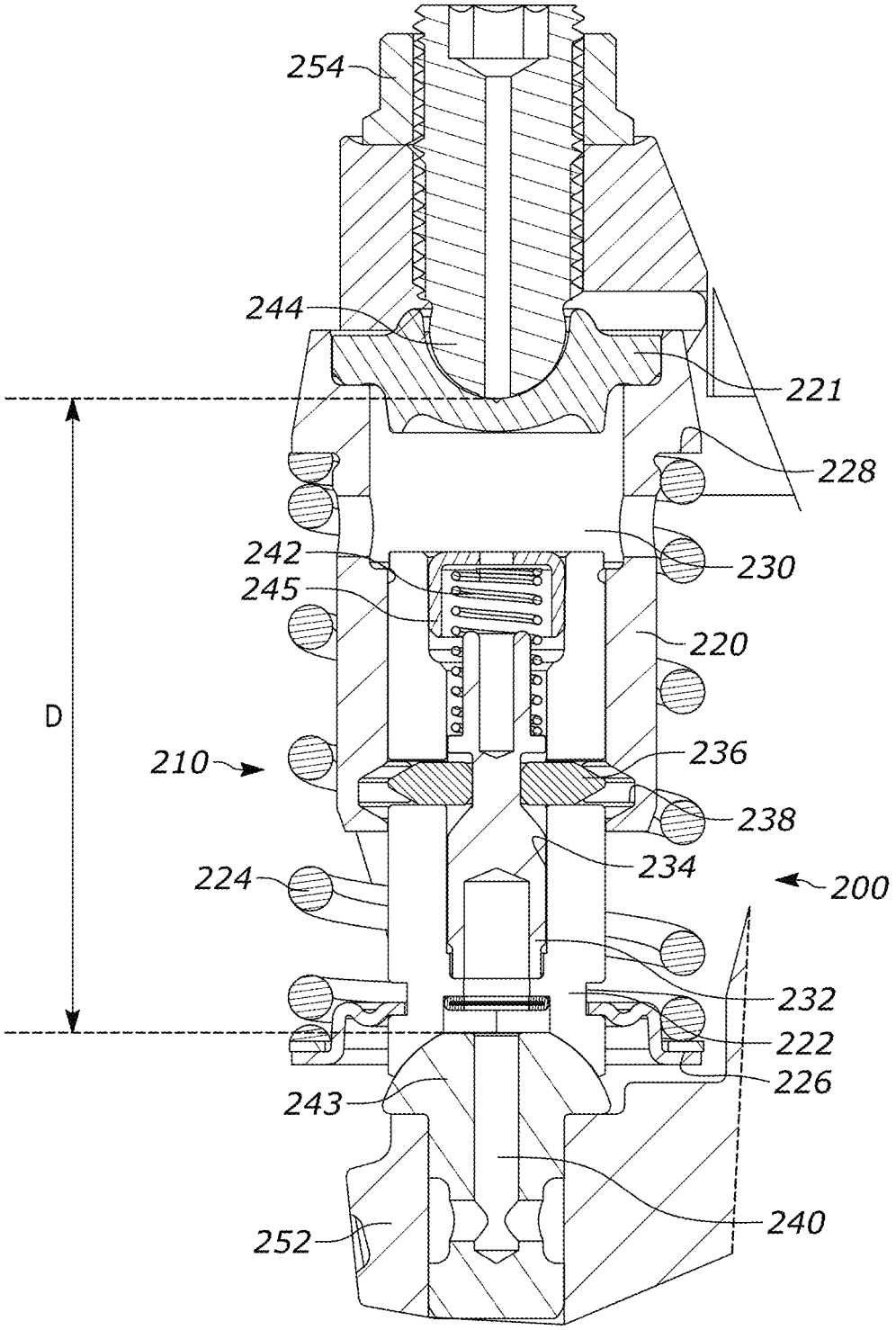
FIG. 2 is a cross-sectional illustration of an example of a lost motion component that may be used to implement the system of FIG. 1.
Figure 4:
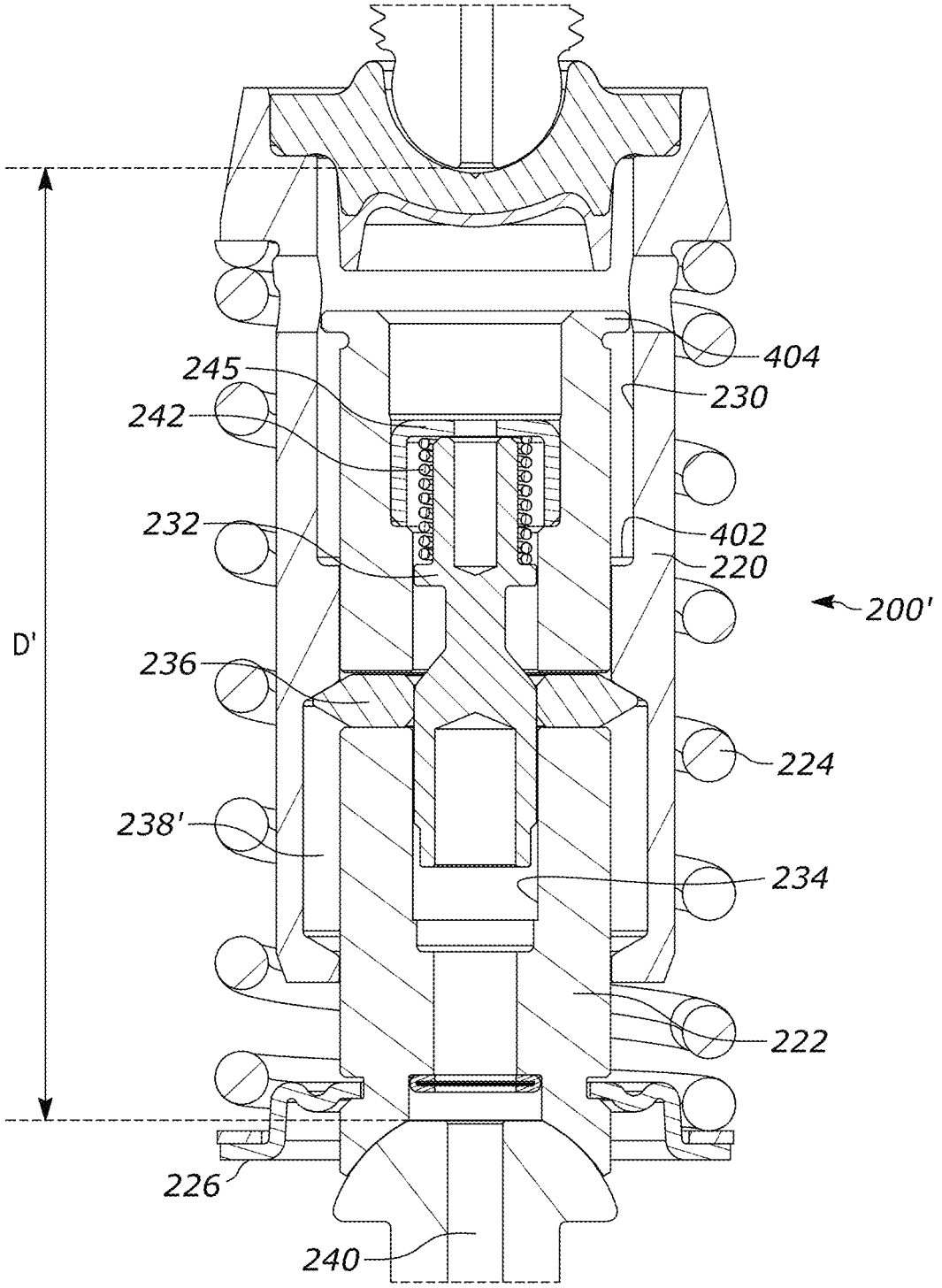
FIG. 4 is a cross-sectional illustration of an alternative example of a lost motion component that may be used to implement the system of FIG. 1 without the need for a carry along feature.

The '611 application further describes a lost motion component that may be employed in place of the carry along feature 190, thereby avoiding the impact issue for the first input rocker 112 by the carry along feature 190. FIG. 4 illustrates an example of such a lost motion component 200'. Elements having like reference numerals in FIGS. 2 and 4 are substantially similar in structure and function, whereas reference numerals including a prime symbol (') in FIG. 4 refer to elements that are characterized by differing structure and/or function relative to counterparts illustrated in FIG. 2, as described below. In the embodiment illustrated in FIG. 4, the lost motion component 200' once again includes a housing 220 having a longitudinal bore 230 formed therein, and a plunger 222 slidably disposed in the bore 230. Likewise, an inner plunger 232 is disposed in a bore 234 formed in the plunger 222 and biased out of the bore 234 by an inner plunger spring 242 disposed between the inner plunger 232 and the plunger cap 245.

Once again, the inner plunger 232 is structured to provide normally unlocked operation, i.e., in the absence of hydraulic control applied to the inner plunger 232, the inner plunger spring 242 biases the inner plunger 232 into position such that the wedges 236 do not radially extend out of openings formed in the plunger 232 and therefore do not engage the outer annular recess 238', thereby effectively unlocking the plunger 222 relative to the housing 220 and permitting the plunger 222 to slide freely within its bore 230, subject to the bias provided by the plunger spring 224.

On the other hand, provision of hydraulic fluid to the input-received end (bottommost surface as shown in FIG. 4) of the inner plunger 232 sufficiently pressurized to overcome the bias of the inner piston spring 242, causes the inner plunger 232 to translate within the bore 234 such that the wedges 236 are forced to extend and engage with the outer recess 238', as shown in FIG. 4, thereby effectively locking the plunger 222 relative to the housing 220.

A further feature of the housing 220 is that the annular outer recess 238' has a longitudinal extent larger than the annular outer recess 238 depicted in FIG. 2. Thus, when the plunger 222 is unlocked from the housing 220 and the first output rocker 116 is commanded by the one-way coupling mechanism 170 as described above, the greater extent of the annular outer recess 238' permits a larger maximum ball to ball distance, D', without risk of dislodgment of the wedges 236 or plunger 222. Additionally, given this larger maximum ball to ball distance, D', the housing 220 and plunger 222 may be biased farther apart by the plunger spring 224 such that the first input rocker 112 is biased into continuous contact with the first motion source 120. Consequently, because the first input rocker 112 is permitted to remain in contact with the first motion source 120, the above-noted impacts between the first input rocker 112 and the first motions source 120 are avoided.

An additional feature of the lost motion component 200' illustrated in FIG. 4 is the provision of stroke limiting features to prevent overextension of the plunger 222 out of the housing 220. In the illustrated example, this stroke limiting features comprise a shoulder 402 formed in the wall defining the housing bore 230 and a corresponding flange or lip 404 formed at an end of the plunger 222 that overlaps with the shoulder 402. In an embodiment, the flange 404 is configured to engage the shoulder 402 as the plunger 222 moves out of (away from) the housing 220 such that the plunger 222 is prevented in all cases from extending beyond a maximum distance out of the housing 220.

Figure 1:
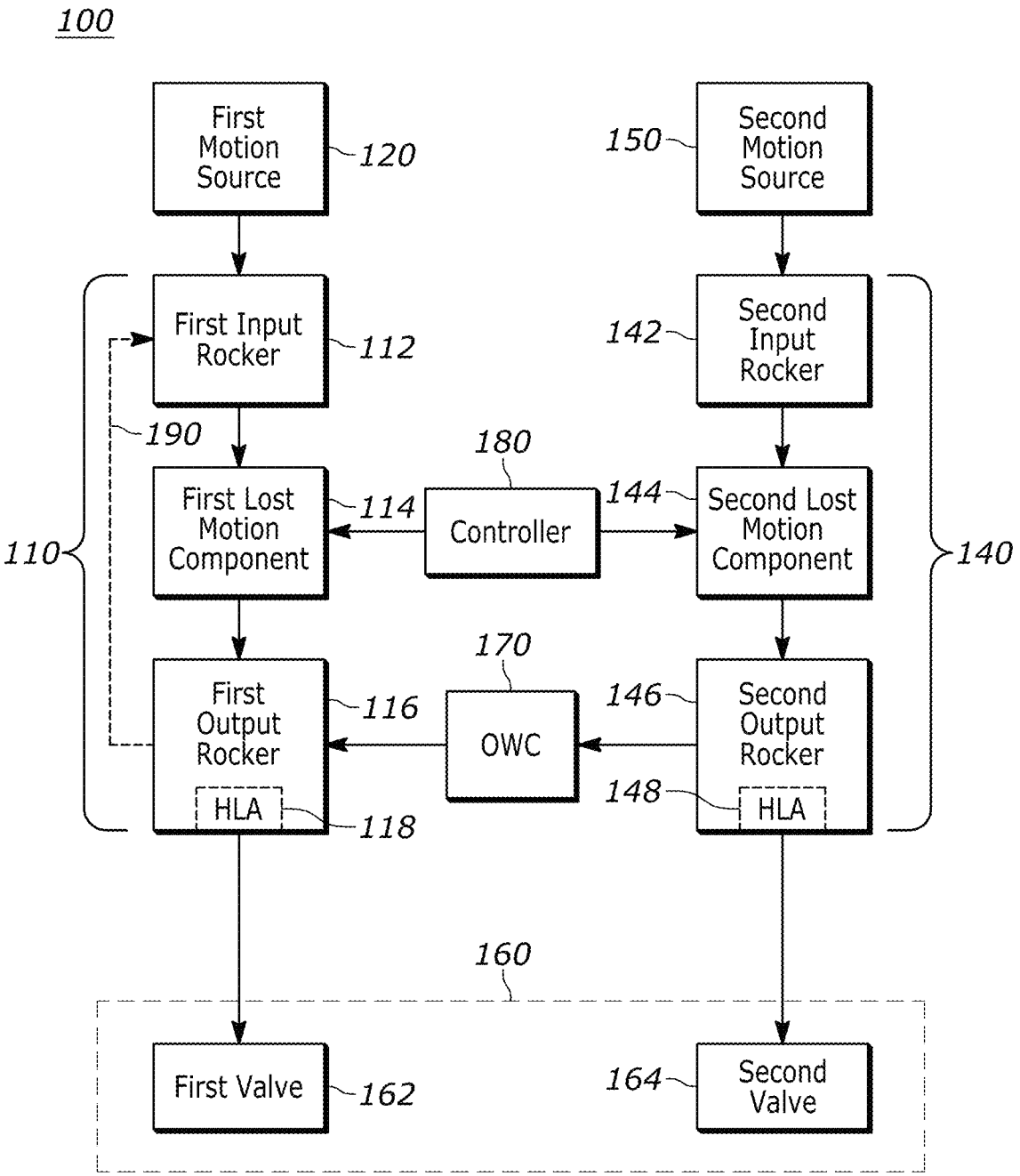
FIG. 1 is a schematic illustration of an embodiment of a valve actuation system, including lost motion components, that may benefit from the teachings of the instant disclosure.

As described above relative to FIG. 1, HLAs 118, 148 may be optionally included in the first and second rocker assemblies 110, 140. However, as described above, a lost motion component 200' of the type illustrated in FIG. 4 permits the plunger spring 224 to constantly applies a bias to both the housing 220 and plunger 222 and, therefore, also to the first input and output rockers 112, 116. If an HLA 118 is positioned between the first output rocker 116 and the first valve 162 as illustrated in FIG. 1, the constant bias applied by the plunger spring 224 to the first output rocker 116 will cause such HLA 118 to collapse and/or prevent it from expanding as required for normal operation.

Figure 3:
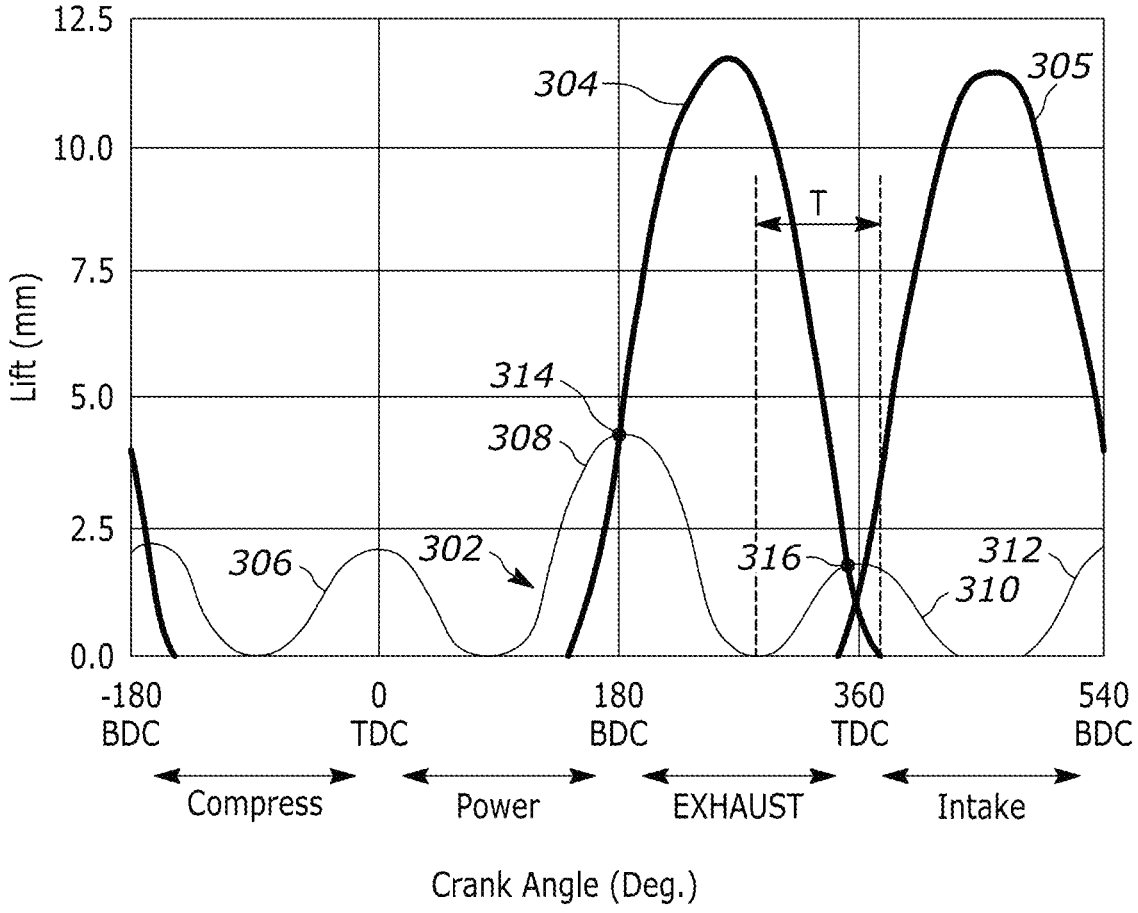
FIG. 3 is graph illustrated main and auxiliary valve events used in conjunction with HPD engine braking.
Figure 10:
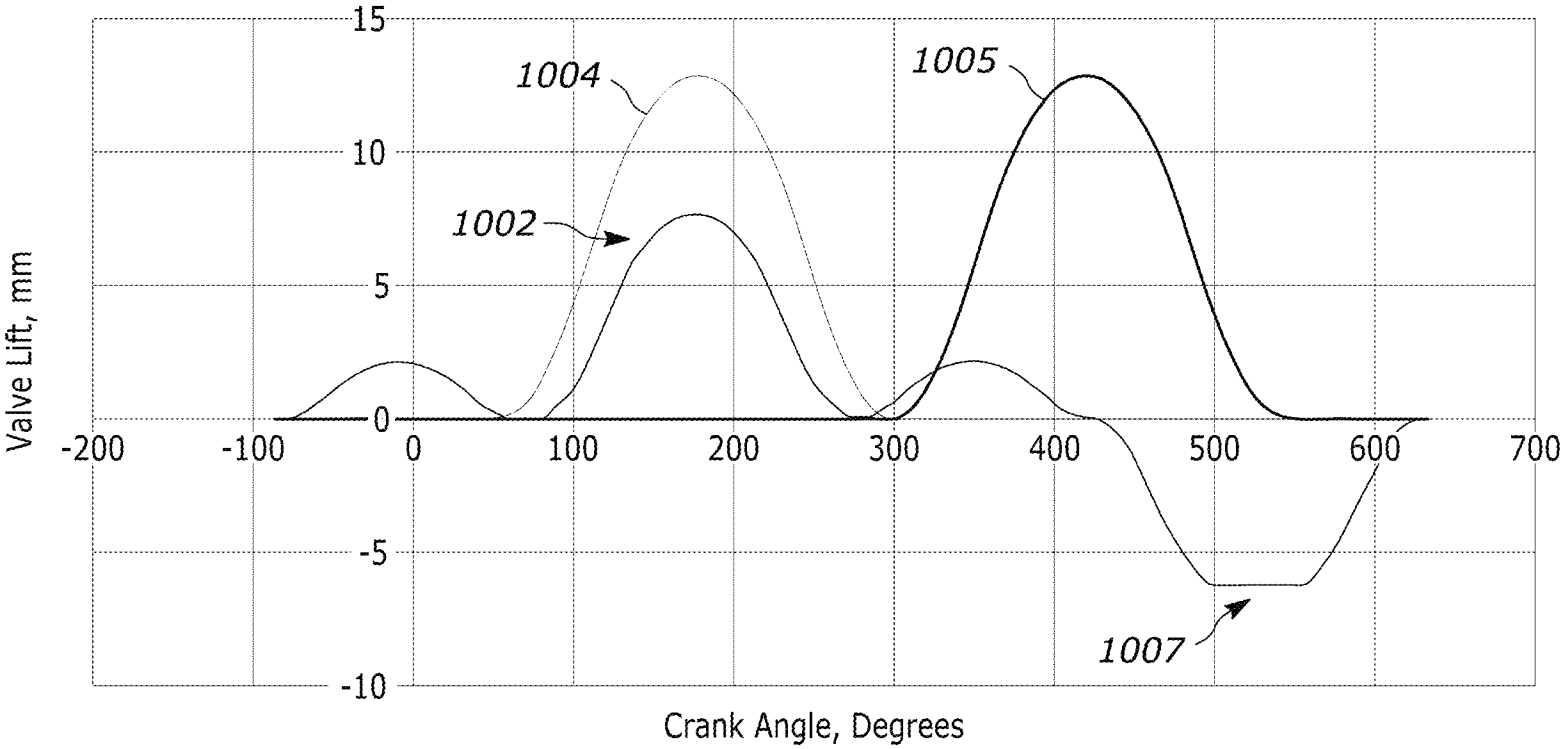
FIG. 10 is a graph illustrating a hydraulic lash adjuster refill period as provided by a first motion source in accordance with a presently preferred embodiment.

In order to accommodate the presence of an HLA in the first rocker assembly 110 (such as HLA 118), the first valve actuation motion source 120 may provide a period of negative valve lift such that the HLA will be unloaded for at least a period of time during each engine cycle (regardless whether the valve actuation motions provided by the first valve actuation motion source 120 are conveyed to the first engine valve 162 or not) such that it may expand and provide a lash take-up force in order to eliminate any lash within the valve train, i.e., the first rocker assembly 110 and the first engine valve 162. An example of this is illustrated in FIG. 10 that, in a manner similar to FIG. 3, illustrates an exhaust main event 1004 and an intake main event 1005 as well as, in this example, auxiliary exhaust valve actuation motions 1002 that can be provided by a first motion source 120. (Note that, in this example, all of the illustrated engine valve events are phased by 65° as compared with the engine valve events illustrated in FIG. 3.) In this case, however, the auxiliary exhaust valve actuation motions 1002 include an HLA refill period 1007 from about 500° to about 560° crank angle in which a constant lift of about-7 mm is provided in a sub-base circle (i.e., below the 0 mm lift axis shown in FIG. 10). The amount of negative lift provided during the HLA refill period 1007 is dictated by the maximum expansion of the first lost motion assembly 114. That is, the HLA refill period 1007 permits the plunger spring 224 bias apart the housing 220 and plunger 222 (as used to implement the first lost motion component 114) to the fullest extent possible, i.e., to the extent permitted by the travel limiting features 402, 404 in the first lost motion component 114. In this state, the first lotion motion assembly 114 cannot expand further and therefore places no load on any HLA in the first rocker assembly 110, which HLA is then free to expand to take up any lash within the first rocker assembly 110 that may have otherwise been taken up by the plunger spring 224 if permitted to expand further.

Figure 5:
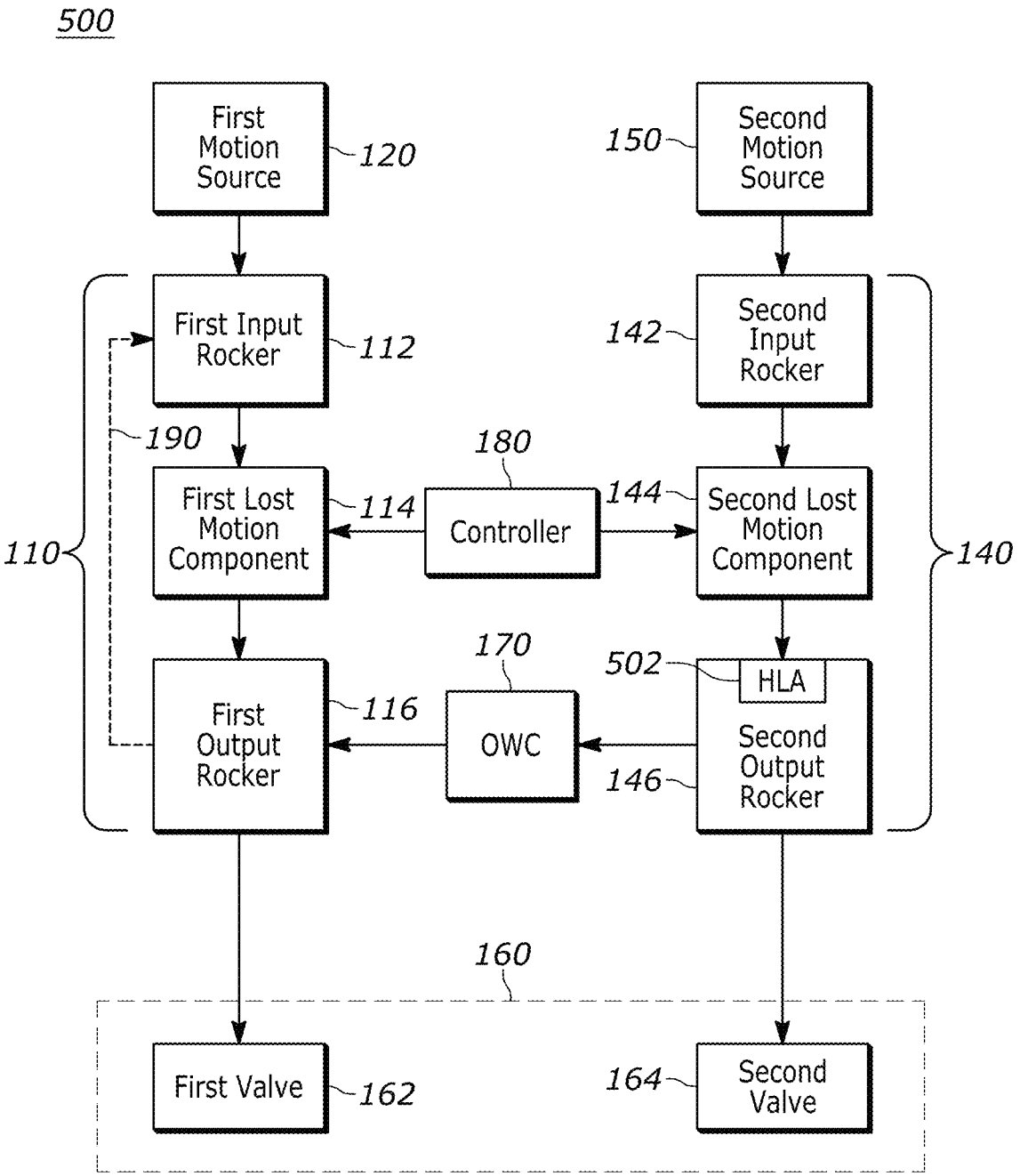
FIG. 5 is a schematic illustration of an embodiment of a valve actuation system, including lost motion components, in accordance with the teachings of the instant disclosure.

In another embodiment, in order to provide the benefits of HLAs while avoiding the above-noted problem arising from the presence of an HLA in the first rocker assembly 110, a system 500 as depicted in FIG. 5 may be employed. As shown, the system 500 is substantially identical to the system 100 of FIG. 1 with the exception that the HLA 148 placed between the second output rocker 146 and the second valve 164 in FIG. 1 has been removed and replaced with a first or primary HLA 502 placed between the second lost motion component 144 and the second output rocker 146. Thus configured, the first HLA 502 can operate to take up lash in the valve train established by the second motion source 150, the second rocker assembly 140 and the second valve 164 in a manner similar to the HLA 148 of FIG. 1. Furthermore, the first lash adjuster 502 can operate on the first output rocker 116 by virtue of the one-way coupling 170, thereby minimizing any lash between the first output rocker 116 and the first engine valve 162. However, because of the presence of the one-way coupling 170, the constant bias applied by the plunger spring 224 (as part of the first lost motion component 114) cannot be applied to the first HLA 502, thereby preventing any interference with operation of the first HLA 502. In other words, the configuration of the first HLA 502 within the second rocker assembly 140 permits the first HLA 502 to be in operative communication with the first output rocker 116 via the one-way coupling 170 and thereby operating upon both the first output rocker 116 and the second rocker assembly 140. It is note that, although the first HLA 502 is illustrated as being disposed within the second output rocker 146, it is appreciated that the first HLA 502 could be disposed elsewhere within the second rocker assembly 140 provided that it is still permitted to operate upon (i.e., apply a lash take-up force to) the first output rocker 116 via the one-way coupling 170.

Figure 6:
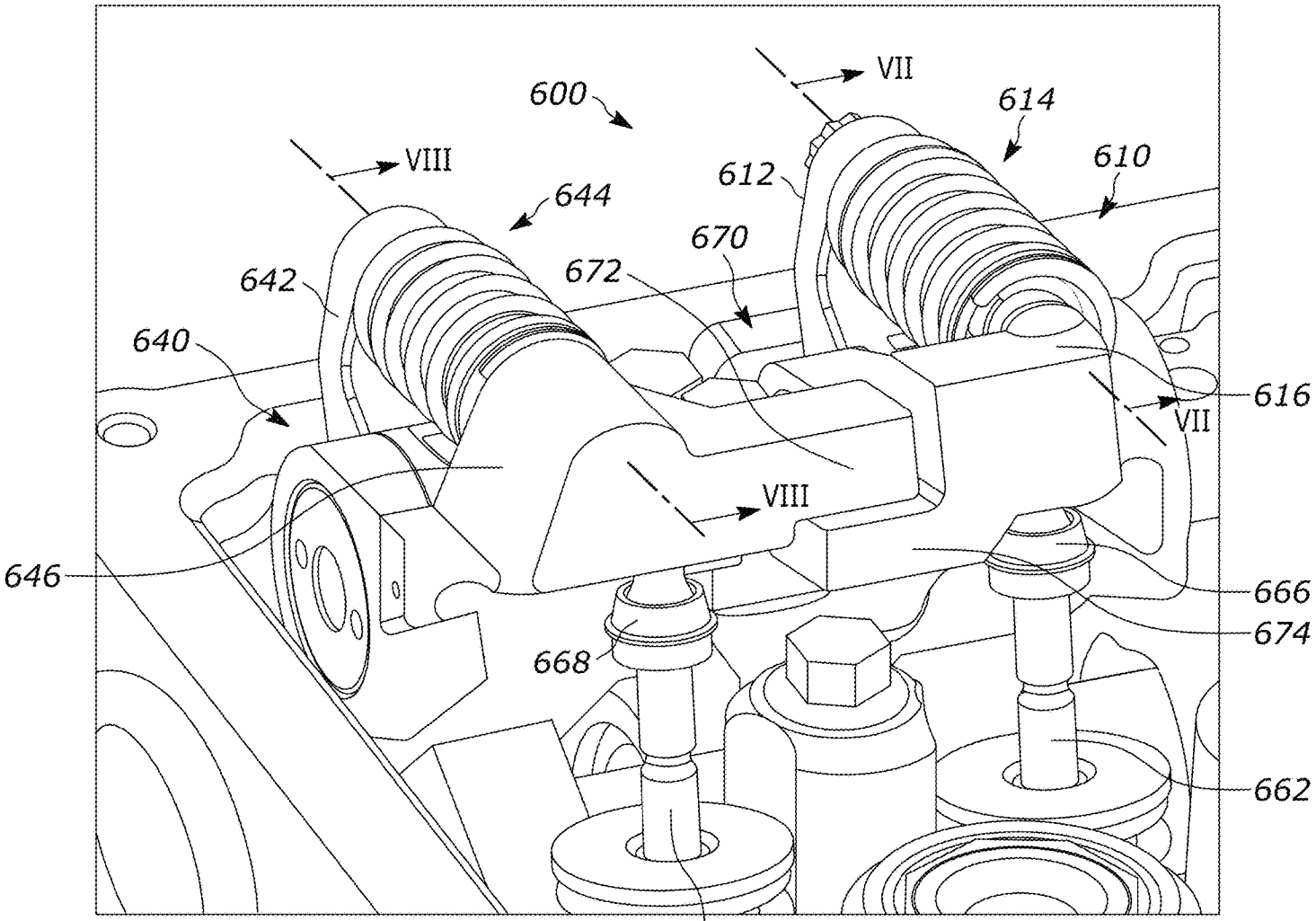
FIGS. 6-8 illustrate a valve actuation system in accordance with FIG. 5.
Figure 7:
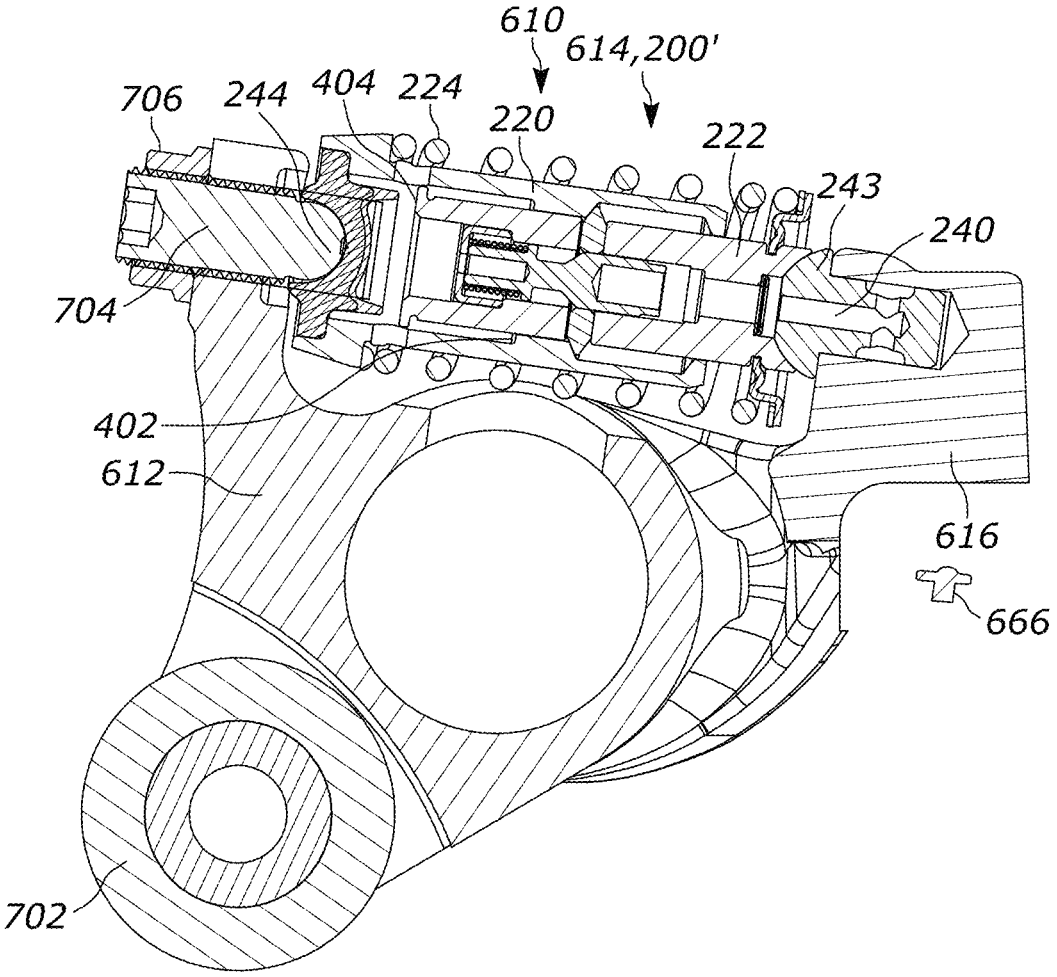
Figure 8:
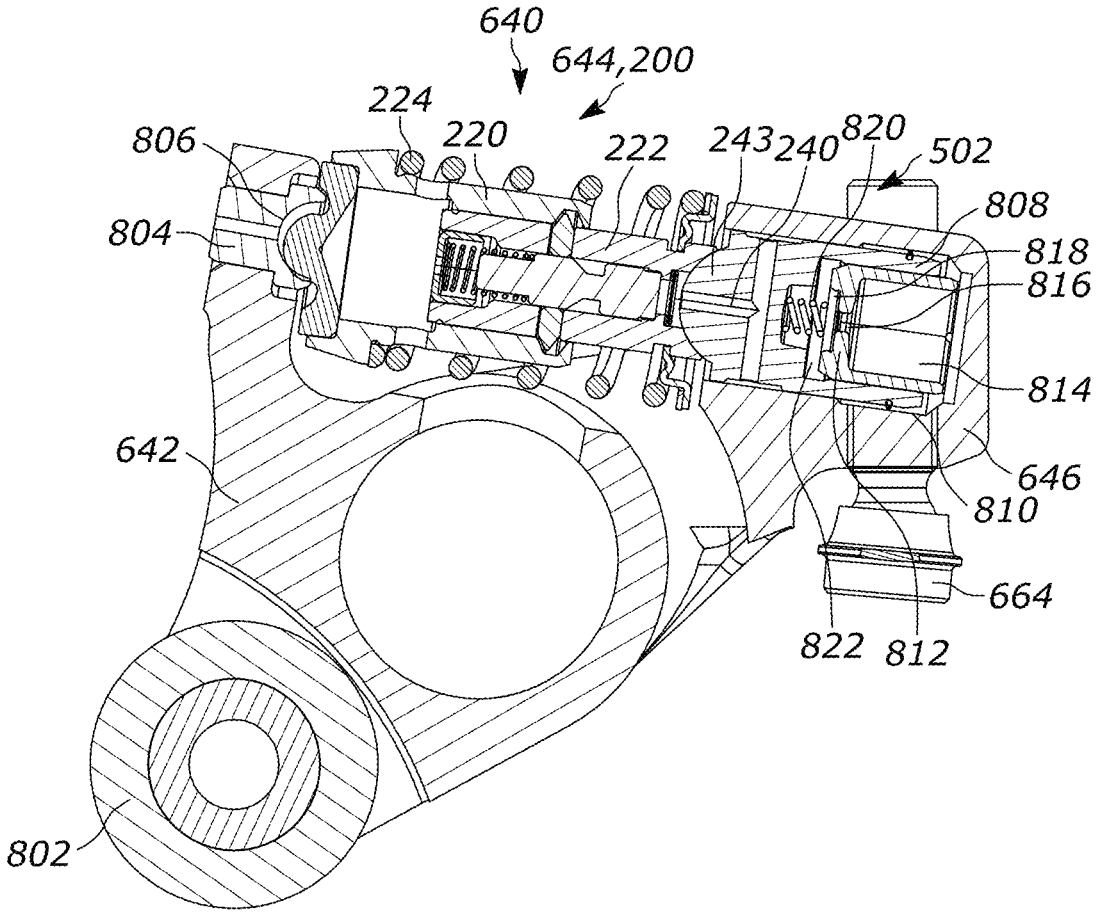

With respect to FIGS. 6-8, a particular implementation of a system 600 in accordance with FIG. 5 is illustrated. The system 600 comprises a first rocker assembly 610 and a second rocker assembly 640 configured to respectively actuate first and second engine valves 662, 664. The first rocker assembly 610 comprises a first input rocker 612 operatively connected to a first lost motion component 614 that, in turn, is operatively connected to a first output rocker 616. Similarly, the second rocker assembly 640 comprises a second input rocker 642 operatively connected to a second lost motion component 644 that, in turn, is operatively connected to a second output rocker 646. As depicted, all of the rockers 612, 616, 642, 646 are half, shaft mounted rockers, though this is not a requirement. As further shown, a one-way coupling 670 is disposed between the second output rocker 646 and the first output rocker 616. In this implementation, the one-way coupling 670 is configured to be non-selectable, i.e., it is "always there," and comprises overlapping extensions 672, 674 integrally formed in and extending away from respective ones of the second and first output rockers 646, 616. Configured as shown, valve actuation motions applied to the second output rocker 646 cause the first extension 672 to contact the second extension 674, thereby also actuating the first output rocker 616. However, valve actuation motions applied to the first output rocker 616 does not result in contact by the second extension 674 with the first extension 672. As further shown in FIG. 6, the first output rocker 616 and the second output rocker 646 each comprise a swivel or e-foot 666, 668 deployed at a motion imparting end thereof and configured to contact the respective first and second engine valves 662, 664.

FIG. 7 illustrates a cross-sectional view of the first rocker assembly 610, which generally comprises the first input rocker 612 operatively connected to the first lost motion component 614, 200', which is in turn operatively connected to the first output rocker 616. The first input rocker 612 comprises a first roller follower 702 configured to contact a first valve actuation motion source, i.e., a cam (not shown). Configured in this manner, valve actuation motions applied to the first roller follower 702 are conveyed by the first input rocker 612 to the first lost motion component 614, 200'. Depending on the locked/unlocked state of the first lost motion component 614, 200', the valve actuation motions applied to the first input rocker 612 may be conveyed/absorbed (lost) by the first lost motion component 614, 200'. When conveyed by the first lost motion component 614, 200', the valve actuation motions are also applied to the first output rocker 616 and on to the first engine valve (not shown).

In this implementation, the connection between the first input rocker 612 and the first lost motion component 614, 200' is provided by a lash adjustment screw 704 terminated at an end proximal to the first lost motion component 614, 200' by the hemispherical ball joint 244. Using known techniques, the lash adjustment screw 407 may be used to set lash within the valve train comprising the first rocker assembly 601, which lash may be maintained by a lock nut 706. Furthermore, as indicated by the reference numerals, the first lost motion component 614, 200' includes the features of the lost motion component 200' described with reference to FIG. 4 such that the first input rocker 612 and the first output rocker 616 are biased away from each other while maintaining the first input rocker 612 in contact with the first valve actuation motion source (not shown) and the first output rocker 616 in contact with a first engine valve (not shown) via the swivel 666.

It is noted that the embodiment illustrated in FIG. 7 includes the stroke limiting features of the overlapping shoulder 402 and flange 404, thereby ensuring that overextension of the plunger 222 relative to the housing 220 cannot occur.

FIG. 8 illustrates a cross-sectional view of the second rocker assembly 640, which generally comprises the second input rocker 642 operatively connected to the second lost motion component 644, 200, which is in turn operatively connected to the second output rocker 646. The second input rocker 642 comprises a second roller follower 802 configured to contact a second valve actuation motion source, i.e., a cam (not shown). In this case, as indicated by the reference numerals, the second lost motion component 644, 200 includes the features of the lost motion component 200 described with reference to FIG. 2 such that the second input rocker 642 and the second output rocker 646 are biased away from each other. Configured in this manner, valve actuation motions applied to the second roller follower 802 are conveyed by the second input rocker 642 to the second lost motion component 644, 200. Depending on the locked/unlocked state of the second lost motion component 644, 200, the valve actuation motions applied to the second input rocker 642 may be conveyed/absorbed (lost) by the first lost motion component 644, 200. When conveyed by the second lost motion component 644, 200, the valve actuation motions are also applied to the second output rocker 646 and on to the first engine valve (not shown).

Control of lash adjustments in the second rocker assembly 640, in keeping with the embodiment of FIG. 5, are handled differently than the first rocker assembly 610. For example, in the place of the lash adjustment screw 704 depicted in FIG. 7, the connection between second input rocker 642 and the second lost motion component 644, 200 is provided by a plug 804 providing, in this case, a concave surface 806 configured to complementarily receive a hemispherical ball joint provided on an end cap of the second lost motion component 644, 200. Instead, lash adjustment within the second rocker assembly 640 is provided by the first HLA 502 operatively connected to both the second lost motion component 644 and the second output rocker 646 as shown (and in accordance with the embodiment of FIG. 5). In accordance with known techniques, the first HLA 502 comprises an HLA housing 808 configured to be threadedly received within an HLA bore 810 formed in a nose of the second output rocker 646. An HLA insert 812 is slidably received in an HLA chamber 814 formed by a bore in the HLA housing 808 and an end surface of the HLA bore 810. The HLA insert 812 forms an orifice 816 that is closed off by a check disk 818 and a check spring 820 disposed in a high pressure chamber 822 formed by space between the HLA housing 808 and the HLA insert 812. As known in the art, the check disk 818 could be equally implemented as a check ball.

As known in the art, when no valve actuation load is applied to the second rocker assembly 640, pressurized hydraulic fluid supplied to the HLA chamber 814 (via suitable hydraulic passages formed in the second output rocker 646 from a pressurized hydraulic fluid supply source; neither shown) may overcome bias applied by the check spring 820 to the check disk 818 such that hydraulic fluid flows from the HLA chamber 814 into the high pressure chamber 822. As further known in the art, a bias force resulting from such hydraulic fluid flow causes the HLA housing 808 and the HLA insert 812 to travel away from each other such that any lash present in the valve train comprising the second rocker assembly 640 is taken up (i.e., substantially reduced or eliminated). Furthermore, as noted with reference to FIG. 5, the bias force applied by the first HLA 502 is also conveyed by the one-way coupling 670 to the first output rocker arm 616, thereby taking up any additional lash space between the first output rocker arm 616 and the first engine valve 662.

Though not illustrated in FIG. 8 (due to rotation of the housing 220 and plunger 222 relative to the cross-sectional plane of FIG. 8), the stroke limiting features of the overlapping shoulder 402 and flange 404 are preferably incorporated into the first lost motion component 644 to once again prevent overextension of the plunger 222 relative to the housing 220.

While systems in keeping with FIGS. 5-8 beneficially permit the use of an HLA to take up lash in valve actuation system, further shortcomings may occur. More specifically, and with reference once again to FIG. 5, during certain valve actuations (e.g., main valve actuations provided by the second motion source 150), the rates at which the first and second engine valves 162, 164 move back toward reseating (so-called valve recession rates) may differ. For example, where the first engine valve 162 is fully reseated before the second engine valve 164 is fully reseated following a main valve actuation, any lash adjustment provided by the first HLA 502 will be set by the first engine valve 162 (via the one-way coupling 170), which would lead to the formation of a gap between the second output rocker 146 and the second engine valve 164.

Figure 9:
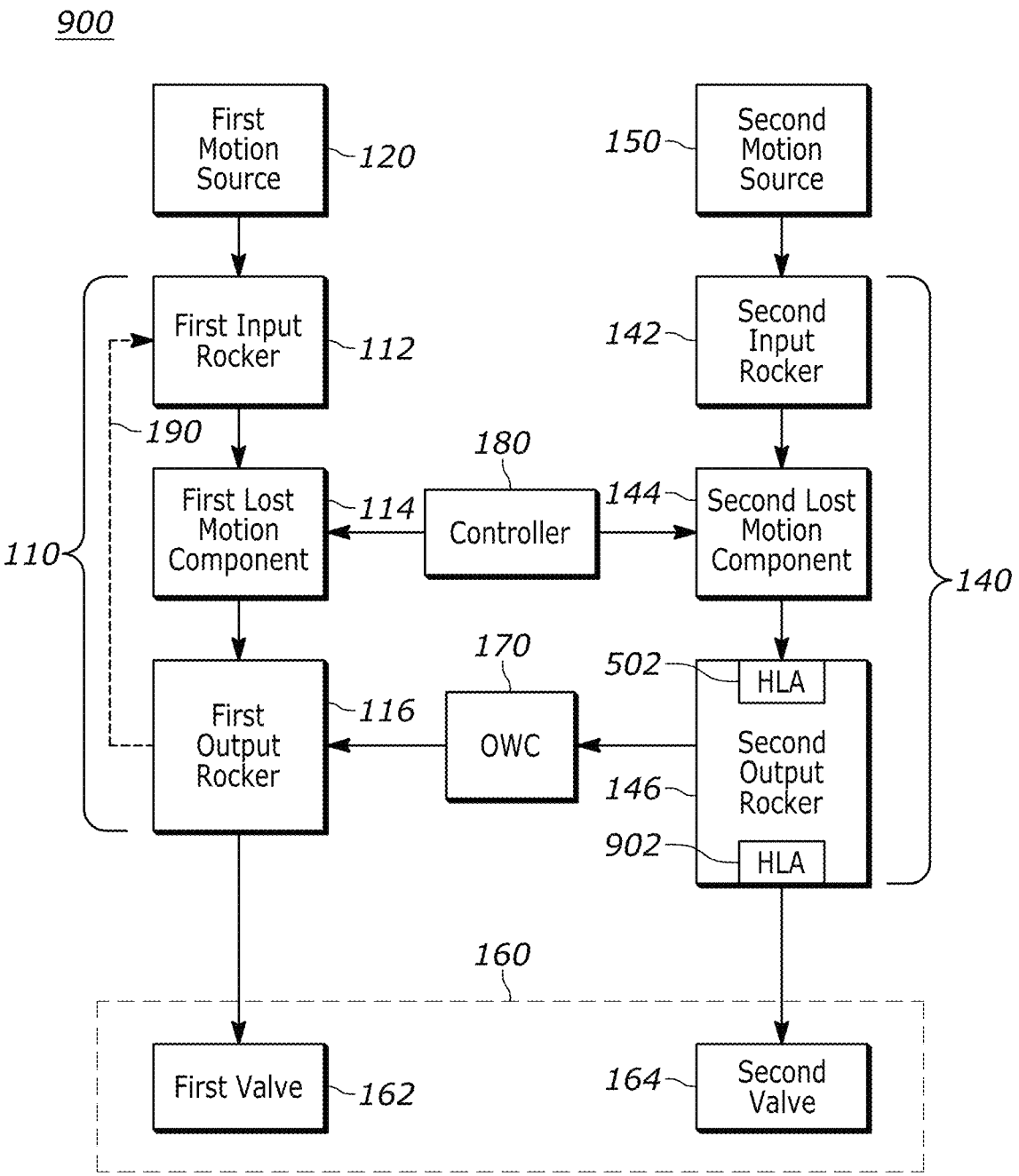
FIG. 9 is a schematic illustration of an alternative embodiment of a valve actuation system, including lost motion components, in accordance with the teachings of the instant disclosure.

To address this possibility, the system 500 of FIG. 5 may be modified as depicted in FIG. 9. The valve actuation system 900 depicted in FIG. 9 is identical to the system 500 shown in FIG. 5 with the exception that a second or secondary HLA 902, in addition to the first HLA 502, is provided between the second output rocker 146 and the second engine valve 164. Thus configured, the second HLA 902 may take up any lash space between the second output rocker 146 and the second engine valve 164 resulting from differing valve recession rates and operation of the first HLA 502 as described above.

Those skilled in the art will appreciate that having the first and second HLAs 502, 902 in series with each other will tend to cause the first and second HLAs 502, 902 to work against each other. To prevent any undesired operating conditions that could arise due to contentions between the first and second HLAs 502, 902, the second HLA 902 can be configured to create a lash prevention bias force that is lower than the lash prevention bias force provided by the first HLA 502. This can be achieved by configuring the HLA housing and HLA insert of the second HLA 902 to have a smaller diameter than the corresponding components in the first HLA 502, albeit operating with the same pressurized hydraulic fluid supply. Configured in this manner, the first HLA 502 is permitted to expand up to a point dictated by the first output rocker 116/first engine valve 162, which also allows the second HLA 902 to expand as dictated by any lash formed between the second output rocker 146 and the second engine valve 164.

Configured as shown in FIG. 9, the first and second HLAs 502, 902 are kept under compressive loads in all operating conditions, thereby preventing any undesirable "jacking" (overextension) of the first and second HLAs 502, 902. For example, and with continued reference to FIG. 9, when positive power generation operation of the engine is desired, the first lost motion component 114 is operated in its unlocked/motion absorbing state and the second lost motion component 144 is operated in its locked/motion conveying state such that auxiliary valve actuation motions will not be conveyed to the first engine valve 162 and main valve actuation motions will be conveyed to both the first and second valves 162, 164. In this case, both the first and second HLAs 502, 902 are continuously in the main motion load path (i.e., from the second motion source 150 to the second engine valve 164) and therefore prevented from overextension.

As another example, where combined valve actuation motions from the first and second motion sources 120, 150 are desired (e.g., compression-release engine braking, IEGR, VVA, EEVO, LIVC, etc.), the first lost motion component 114 is operated in its locked/motion conveying state and the second lost motion component 144 is also operated in its locked/motion conveying state such that auxiliary valve actuation motions will be conveyed to the first engine valve 162 and main valve actuation motions will be conveyed to both the first and second valves 162, 164. In this case, opportunities for gaps between the components of the one way coupling 170 (the overlapping extensions 672, 674 in the example of FIG. 6) will form when the second motion source 150 is not providing any valve actuation motions via the second rocker assembly 140 (e.g., where a cam providing the second motion source 150 is at base circle) whereas the first motion source 120 is providing valve actuation motions via the first rocker assembly 110. An example of such a state is illustrated in FIG. 3 where, at 0° crank angle, no main exhaust valve actuation motion 304 is provided but a first compression-release valve actuation motion 306 is provided. In this case, despite the separation between the components forming the one way coupling 170, the first and second HLAs 502, 902 remain under compression by virtue of, for example, the plunger spring 224 found in the first lost motion component 114.

As yet another example, where auxiliary-only valve actuation operation of the engine is desired (e.g., 1.5-stroke or 2-stroke compression-release engine braking), the first lost motion component 114 is operated in its locked/motion conveying state and the second lost motion component 144 is operated in its unlocked/motion absorbing state such than auxiliary valve actuation motions will be conveyed to the first engine valve 162 whereas main valve actuation motions will not be conveyed to either the first or second valves 162, 164. In this case, no valve actuation motions from the second motion source 150 will be conveyed via the second rocker assembly 140, i.e., no compression will be applied to first or second HLAs 502, 902 by virtue of any main valve actuation motions. However, once again, the first and second HLAs 502, 902 will remain under compression by virtue of the plunger spring 224 found in the first lost motion component 114.

What is claimed is:

1. A system for actuating at least two engine valves associated with a cylinder of an internal combustion engine, comprising:

a first rocker assembly operatively connected to a first valve actuation motion source and to a first engine valve of the at least two engine valves, the first rocker assembly comprising a first lost motion component arranged in series with a first input rocker and a first output rocker, the first input rocker configured to receive first valve actuation motions from the first valve actuation motion source and the first output rocker configured to impart the first valve actuation motions to the first engine valve, wherein the first lost motion component is operable, in a motion absorbing state, to prevent conveyance of the first valve actuation motions from the first input rocker to the first output rocker and, in a motion conveying state, to convey the first valve actuation motions from the first input rocker to the first output rocker;

a second rocker assembly operatively connected to a second valve actuation motion source and to a second engine valve of the at least two engine valves, the second rocker assembly comprising a second lost motion component arranged in series with a second input rocker and a second output rocker, the second input rocker configured to receive second valve actuation motions from the second valve actuation motion source and the second output rocker configured to impart the second valve actuation motions to the second engine valve, wherein the second lost motion component is operable, in a motion absorbing state, to prevent conveyance of the second valve actuation motions from the second input rocker to the second output rocker and, in a motion conveying state, to convey the second valve actuation motions from the second input rocker to the second output rocker; and a one-way coupling mechanism disposed between the first output rocker and the second output rocker such that the second valve actuation motions are transferred from the second output rocker to the first output rocker, and the first valve actuation motions are not transferred from the first output rocker to the second output rocker, wherein a primary hydraulic lash adjuster is configured in the second rocker assembly such that the primary hydraulic lash adjuster operates upon the first output rocker via the one-way coupling mechanism.

2. The system of claim 1, wherein the primary hydraulic lash adjuster is disposed in the second output rocker.

3. The system of claim 1, wherein each of the first input rocker, the first output rocker, the second input rocker and the second output rocker comprises a shaft-mounted half rocker.

4. The system of claim 1, wherein the one-way coupling mechanism comprises a second extension forming a part of the second output rocker and a first extension forming a part of the first output rocker, and wherein the first and second extensions are configured to contact each other.

5. The system of claim 1, wherein the first lost motion component comprises a hydraulically controlled locking mechanism.

6. The system of claim 1, wherein the first lost motion component comprises a first spring that biases the first input rocker toward the first valve actuation motion source and biases the first output rocker toward the first engine valve.

7. The system of claim 1, wherein the first lost motion component has a longitudinal extent sufficient to accommodate motions applied to the first output rocker via the one-way coupling mechanism.

8. The system of claim 1, wherein the first lost motion component is configured to be stroke-limited.

9. The system of claim 1, further comprising:

a secondary hydraulic lash adjuster disposed between the second output rocker and the second engine valve.

10. The system of claim 9, wherein a secondary lash prevention force provided by the secondary hydraulic lash adjuster is less than a primary lash prevention force provided by the primary hydraulic lash adjuster.

11. The system of claim 1, wherein the second lost motion component comprises a hydraulically controlled locking mechanism.

12. The system of claim 1, wherein the second lost motion component comprises a second spring that biases the first input rocker toward the second valve actuation motion source and biases the second output rocker toward the second engine valve.

13. The system of claim 1, wherein the second lost motion component is configured to be stroke-limited.

14. A system for actuating at least two engine valves associated with a cylinder of an internal combustion engine, comprising:

a first rocker assembly operatively connected to a first valve actuation motion source and to a first engine valve of the at least two engine valves, the first rocker assembly comprising a first lost motion component arranged in series with a first input rocker and a first output rocker, the first input rocker configured to receive first valve actuation motions from the first valve actuation motion source and the first output rocker configured to impart the first valve actuation motions to the first engine valve, wherein the first lost motion component is operable, in a motion absorbing state, to prevent conveyance of the first valve actuation motions from the first input rocker to the first output rocker and, in a motion conveying state, to convey the first valve actuation motions from the first input rocker to the first output rocker;

a second rocker assembly operatively connected to a second valve actuation motion source and to a second engine valve of the at least two engine valves, the second rocker assembly comprising at least one second rocker configured to receive second valve actuation motions from the second valve actuation motion source and to impart the second valve actuation motions to the second engine valve; and a one-way coupling mechanism disposed between the first output rocker and the at least one second rocker such that the second valve actuation motions are transferred from the at least one second rocker to the first output rocker, and the first valve actuation motions are not transferred from the first output rocker to the at least one second rocker, wherein the first rocker assembly comprises a hydraulic lash adjuster, and wherein the first valve actuation motion source includes a refill period comprising a sub-base circle lift configured to eliminate load placed upon the hydraulic lash adjuster by expansion of the first lost motion component.

15. The system of claim 14, wherein the at least one second rocker comprises:

a second lost motion component arranged in series with a second input rocker and a second output rocker, the second input rocker configured to receive the second valve actuation motions from the second valve actuation motion source and the second output rocker configured to impart the second valve actuation motions to the second engine valve, wherein the second lost motion component is operable, in a motion absorbing state, to prevent conveyance of the second valve actuation motions from the second input rocker to the second output rocker and, in a motion conveying state, to convey the second valve actuation motions from the second input rocker to the second output rocker.

* * * * *